US010377524B2

(12) United States Patent
Sumitomo

(10) Patent No.: US 10,377,524 B2
(45) Date of Patent: Aug. 13, 2019

(54) CUSHIONING PAD AND PACKAGE

(71) Applicant: KYOCERA Document Solutions Inc., Osaka (JP)

(72) Inventor: Seiji Sumitomo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/708,799

(22) Filed: Sep. 19, 2017

(65) Prior Publication Data

US 2018/0079549 A1 Mar. 22, 2018

(30) Foreign Application Priority Data

Sep. 21, 2016 (JP) ..... 2016-184284

(51) Int. Cl.
*B65D 5/50* (2006.01)

(52) U.S. Cl.
CPC ..... *B65D 5/505* (2013.01)

(58) Field of Classification Search
CPC ..... B65D 5/5035; B65D 5/505; B65D 5/50; B65D 81/05; B65D 81/07; B65D 81/107
USPC ..... 206/583, 591, 592, 593, 594, 586
See application file for complete search history.

(56) References Cited

U.S. PATENT DOCUMENTS 3,086,689 A * 4/1963 Wiedenmeier ..... B65D 5/5042 206/521
3,101,166 A * 8/1963 Van Antwerpen ..... B65D 5/504 206/454
3,362,609 A * 1/1968 Freedy ..... B65D 5/504 206/454
3,519,244 A * 7/1970 Lidgard ..... B65D 85/48 206/448
3,559,866 A * 2/1971 Olson, Sr. ..... B65D 5/504 206/454
6,170,789 B1 1/2001 Hayakawa
7,299,926 B2 * 11/2007 Russell ..... B65D 5/5035 206/521
7,320,406 B2 * 1/2008 Auclair ..... B65D 5/5045 206/588

(Continued)

FOREIGN PATENT DOCUMENTS

JP 2000-33943 A 2/2000
JP 2010-036925 A 2/2010
KR 20-0480559 Y1 6/2016

OTHER PUBLICATIONS

An Office Action; "Notice of Reasons for Refusal," issued by the Japanese Patent Office dated May 14, 2019, which corresponds to Japanese Patent Application No. 2016-184284 and is related to U.S. Appl. No. 15/708,799; with English Translation.

*Primary Examiner* — Steven A. Reynolds
(74) *Attorney, Agent, or Firm* — Studebaker & Brackett PC

(57) ABSTRACT

A cushioning pad is disposed between a packing and a packed article. The cushioning includes a bottom plate portion, a first tubular portion, and a second tubular portion. The bottom plate has a pair of end areas opposite to each other. The first tubular portion has a triangular tubular shape along one of the end areas. The second tubular portion has a triangular tubular shape along another of the end areas. The one of the end areas resiliently deformers into an arc shape upon impact acting on the first tubular portion. The other of the end areas resiliently deformers into an arc shape upon impact acting on the first tubular portion.

8 Claims, 7 Drawing Sheets

(56) References Cited

U.S. PATENT DOCUMENTS

| | | | | |
|---|---|---|---|---|
| 7,882,956 | B2 * | 2/2011 | McDonald | B65D 81/07 206/583 |
| 2003/0034273 | A1 * | 2/2003 | Auclair | B65D 5/5035 206/583 |
| 2012/0272620 | A1 * | 11/2012 | McDonald | B65D 5/5028 53/441 |

* cited by examiner

CUSHIONING PAD AND PACKAGE

INCORPORATION BY REFERENCE

The present application claims priority under 35 U.S.C. § 119 to Japanese Patent Application No. 2016-184284, filed on Sep. 21, 2016. The contents of this application are incorporated herein by reference in their entirety.

BACKGROUND

The present disclosure relates to a cushioning pad and a package.

Some cushioning pad has a rectangular tubular shape. The cushioning pad includes an upper plate, right and left side plates, and a bottom plate. A plurality of cut lines are formed on each of the side plates. The cut lines each extend in an up-and-down direction. The cut lines are formed in a central part of the side plate in the up-and-down direction except upper and lower end areas of the side plate. The cut lines are arranged side by side in a front-back direction. In the above configuration, the side plate includes a plurality of flexible parts divided by the cut lines.

A cushioning characteristic is imparted to the cushioning pad when the side plates are folded inward. The side plate is folded along a fold line extending in the front-back direction through the center of the side plate in the up-and-down direction. The flexible parts each are capable of being folded outward opposite to a folding direction of the side plate. When the number of flexible parts folded outward is adjusted, strength of the cushioning characteristic of the cushioning pad can be adjusted.

SUMMARY

A cushioning pad according to the present disclosure is disposed between a packing and a packed article. The cushioning includes a bottom plate portion, a first tubular portion, and a second tubular portion. The bottom plate has a pair of end areas opposite to each other. The first tubular portion has a triangular tubular shape along one of the end areas. The second tubular portion has a triangular tubular shape along another of the end areas. The one of the end areas resiliently deforms into an arc shape upon impact acting on the first tubular portion. The other of the end areas deforms into an arc shape upon impact acting on the second tubular portion.

A package according to the present disclosure includes the above cushioning pad and a main body. The main body has a box shape. The main body accommodates the cushioning pad and the package.

DETAILED DESCRIPTION

Figure 1:
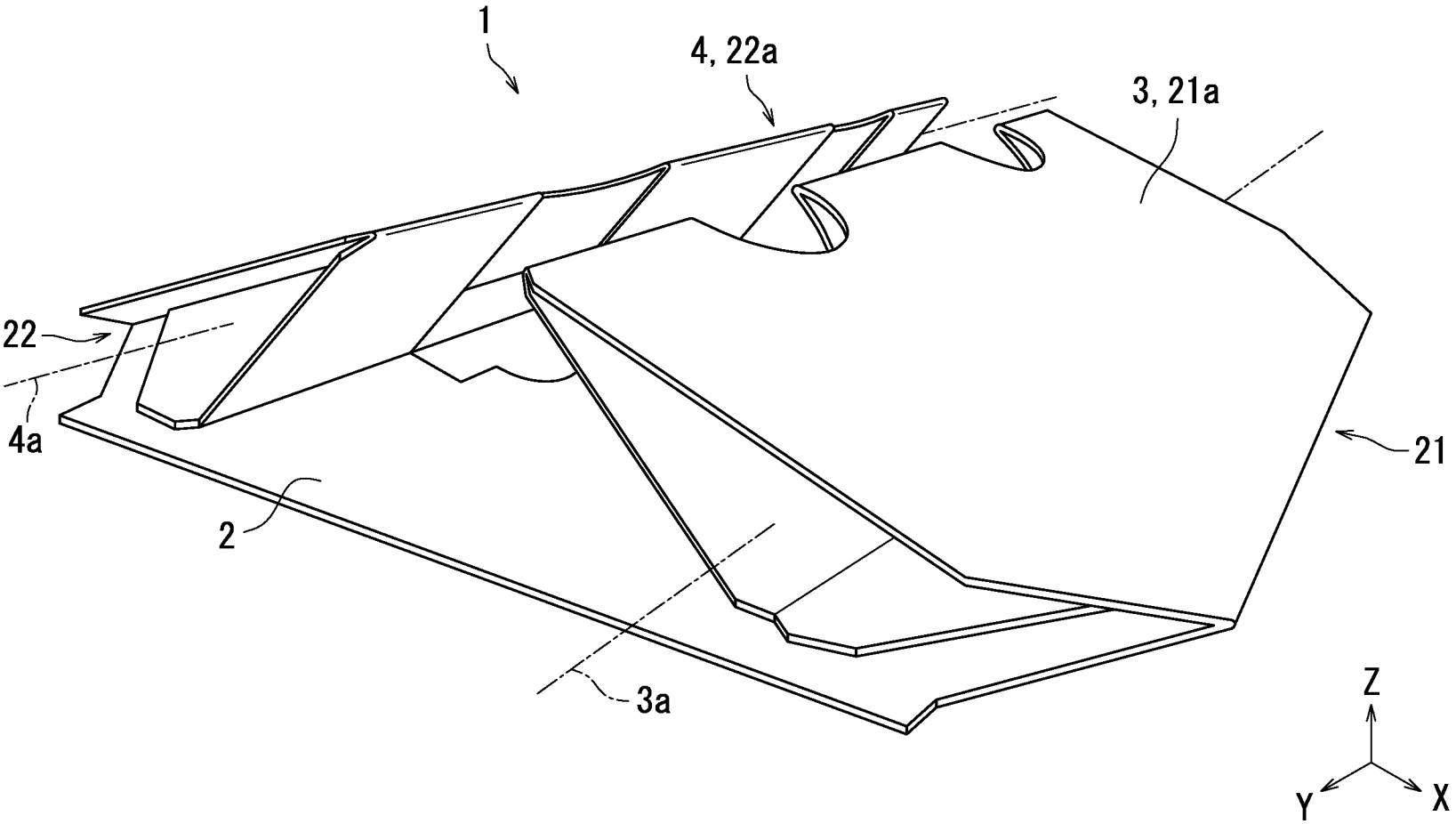
FIG. 1 is a perspective view illustrating a cushioning pad according to an embodiment of the present disclosure.

The following describes an embodiment of the present disclosure with reference to the accompanying drawings. However, the present disclosure is not limited to the specific embodiment described below. Elements that are the same or equivalent are marked using the same reference signs in the drawings and explanation thereof is not repeated.

Configuration of cushioning pad 1 according to an embodiment of the present disclosure will be described with reference to FIG. 1. FIG. 1 is a perspective view illustrating the cushioning pad 1 according to the embodiment of the present disclosure. As illustrated in FIG. 1, the cushioning pad 1 includes a bottom plate portion 2, a first tubular portion 3, and a second tubular portion 4.

The bottom plate portion 2 has a plate shape. The bottom plate portion 2 includes end areas 21 and 22 opposite to each other. The bottom plate portion 2 has for example a rectangular shape in plan. The first tubular portion 3 continues from the end area 21 of the bottom plate portion 2. The second tubular portion 4 continues from the end area 22 of the bottom plate portion 2.

The first tubular portion 3 has a triangular tubular shape. The first tubular portion 3 is formed by folding a plate-shaped member 21*a* extending from the end area 21 of the bottom plate portion 2. The second tubular portion 4 has a triangular tubular shape similar to that of the first tubular portion 3. The second tubular portion 4 is formed by folding a plate-shaped member 22*a* extending from the end area 22 of the bottom plate portion 2. In the above configuration, the first and second tubular portions 3 and 4 are located opposite to each other.

Here, a direction in which respective central axes 3*a* and 4*a* of the first and second tubular portions 3 and 4 extend is defined as a front-back direction Y. A direction perpendicular to the front-back direction Y in a horizontal direction is defined as a left-right direction X. Also, a direction perpendicular to the left-right direction X and the front-back direction Y is defined as an up-and-down direction Z.

Figure 2:
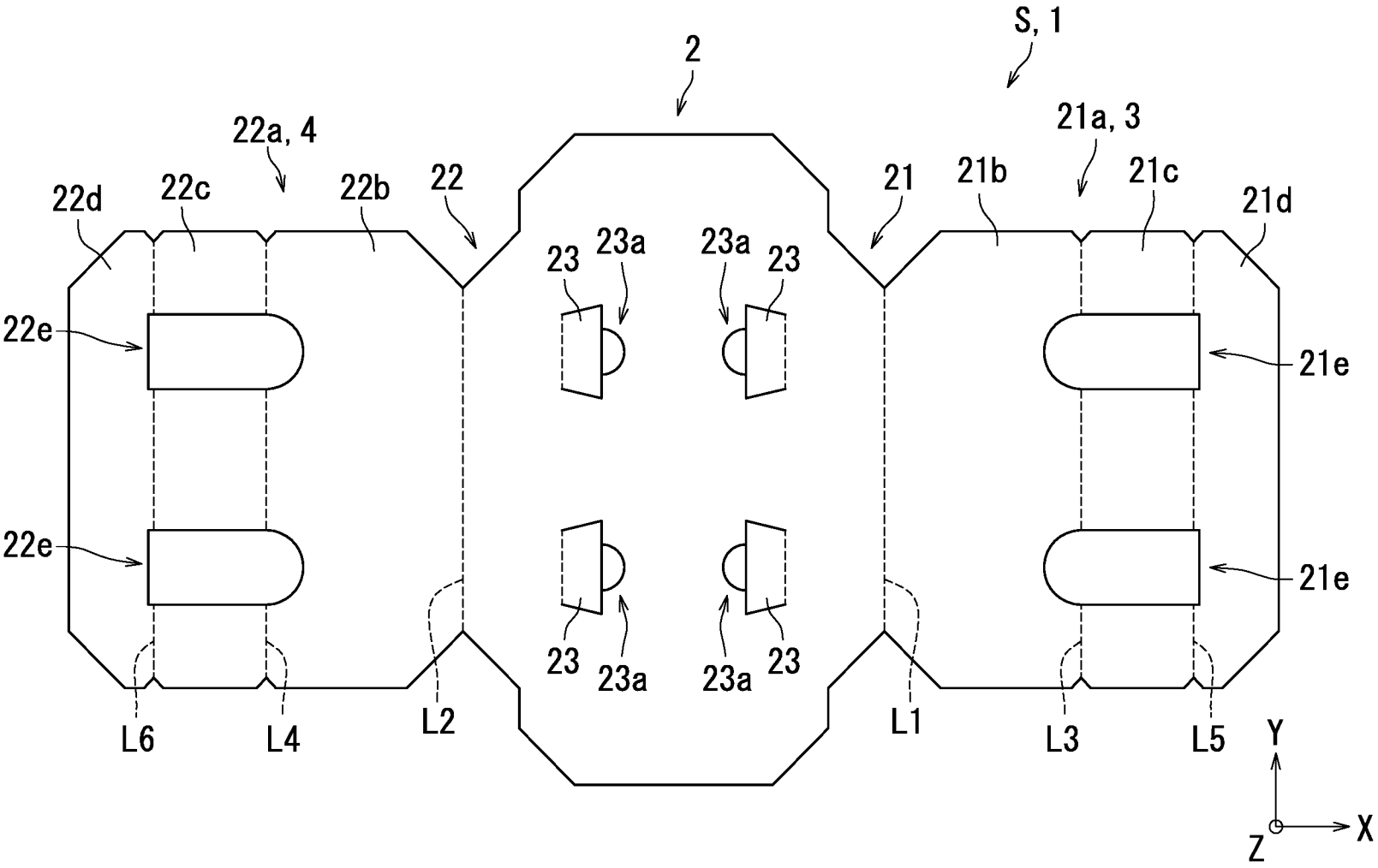
FIG. 2 illustrates a sheet to which the cushioning pad in FIG. 1 is developed.

The configuration of the cushioning pad 1 will be further described with reference to FIG. 2. FIG. 2 illustrates a sheet S to which the cushioning pad 1 is developed. Specifically, the sheet S in FIG. 2 shows an internal surface of the cushioning pad 1. Chain lines in FIG. 2 each indicate a location where the sheet S is folded.

As illustrated in FIG. 2, the sheet S has a plate shape. The sheet S is for example made from paper such as cardboard. The sheet S has for example a thickness of 3.0 mm. The cushioning pad 1 is formed from a single sheet S folded along the respective chain lines.

The sheet S is divided into the bottom plate portion 2 and the plate-shaped members 21*a* and 22*a*. The bottom plate portion 2 and the plate-shaped members 21*a* and 22*a* are divided by chain lines L1 and L2. The chain line L1 extends along the end area 21 of the bottom plate portion 2. The chain line L2 extends along the end area 22 of the bottom plate portion 2. In the above configuration, the plate-shaped member 22*a*, the bottom plate portion 2, and the plate-shaped member 21*a* are connected in series in stated order in the left-right direction X.

The plate-shaped member 21*a* is divided into a base segment 21*b*, an intermediate segment 21*c*, and a tip end segment 21*d*. The base segment 21*b*, the intermediate segment 21*c*, and the tip end segment 21*d* are divided by chain lines L3 and L5. The chain lines L3 and L5 each extend in parallel to the chain line L1. The chain line L3 is located closer to the chain line L1 than the chain line L5. That is, the chain line L3 is located between the chain lines L5 and L1. In the above configuration, the base segment 21*b*, the intermediate segment 21*c*, and the tip end segment 21*d* are connected in series in stated order in the left-right direction X.

The plate-shaped member 21*a* has a pair of holes 21*e*. The holes 21*e* each are an example of an engagement target in the present disclosure. The holes 21*e* are located side by side with a specific distance therebetween in the front-back direction Y.

The holes 21*e* are located for example across the intermediate segment 21*c* in the left-right direction X. The holes 21*e* extend for example into the tip end segment 21*d* by the thickness of the sheet S. That is, the length from the chain line L5 to the right end of each of the holes 21*e* is equal to the thickness of the sheet S. The holes 21*e* also extend into the base segment 21*b* by a predetermined length. The predetermined length refers to a length from the chain line L3 to the apex of each of the holes 21*e*.

The plate-shaped member 22*a* is divided into a base segment 22*b*, an intermediate segment 22*c*, and a tip end segment 22*d*. The base segment 22*b*, the intermediate segment 22*c*, and the tip end segment 22*d* are divided by chain lines L4 and L6. The chain lines L4 and L6 each extend in parallel to the chain line L1. The chain line L4 is located closer to the chain line L2 than the chain line L6. That is, the chain line L4 is located between the chain lines L6 and L2. In the above configuration, the tip end segment 22*d*, the intermediate segment 22*c*, and the base segment 22*b* are connected in series in stated order in the left-right direction X.

The plate-shaped member 22*a* has a pair of holes 22*e*. The holes 22*e* each are an example of the engagement target in the present disclosure. The holes 22*e* are located side by side with a specific distance therebetween in the front-back direction Y.

The holes 22*e* are located for example across the intermediate segment 22*c* in the left-right direction X. The holes 22*e* extend for example into the tip end segment 22*d* by the thickness of the sheet S. That is, the length from the chain line L6 to the left end of each of the holes 22*e* is equal to the thickness of the sheet S. The holes 22*e* also extend into the base segment 22*b* by a predetermined length. The predetermined length refers to a length from the chain line L4 to the apex of each of the holes 22*e*.

The bottom plate portion 2 includes a plurality of engagement parts 23. Four engagement parts 23 of which number is equal to the sum of the number of holes 21*e* and 22*e* are included in the bottom plate portion 2. The engagement parts 23 each are provided at a location corresponding to one of the holes 21*e* and 22*e*. Each of the engagement parts 23 has a trapezoidal shape. The engagement part 23 has a base end located on a side of a short base thereof. The engagement part 23 has a tip end located on a side of a long base thereof. The short and long bases are parallel to each other. A fold is formed on the bottom plate portion 2 along the short base of the engagement part. A cut is formed on the bottom plate portion 2 along the long base and legs of the trapezoidal shape.

Semicircular holes 23*a* each adjoin to a corresponding one of the engagement parts 23. Specifically, the hole 23*a* meets the long base of the engagement part 23. An operator in assembling the cushioning pad 1 can insert the fingers in the holes 23*a*. As a result, the engagement parts 23 can be readily turned up, thereby reducing burden on the operator.

A method for assembling the cushioning pad 1 will be described next with reference to FIGS. 1 and 2. The sheet S is folded frontward of the drawing surface of FIG. 2 along the chain lines L1-L6.

When the sheet S is folded up, the holes 21*e* and 22*e* each engage with a corresponding one of the engagement parts 23. Specifically, when the plate-shaped members 21*a* and 22*a* are folded up, parts of the plate-shaped members 21*a* and 22*a* along the respective chain lines L5 and L6 each come close to corresponding two of the engagement parts 23. In the above situation, the engagement parts 23 that are turned up each engage with a corresponding one of the holes 21*e* and 22*e*. The engagement parts 23 each have a trapezoidal shape. The parts of the engagement parts 23 corresponding to the long base are each engaged with a corresponding one of the holes 21*e* and 22*e* to increase strength in engagement between the engagement parts 23 and the holes 21*e* and 22*e*.

Engagement between the holes 21*e* and 22*e* and the corresponding engagement parts 23 maintains the shape of the cushioning pad 1. In the above configuration, the operator can assemble the cushioning pad 1 without using a bonding agent such as glue.

Figure 3:
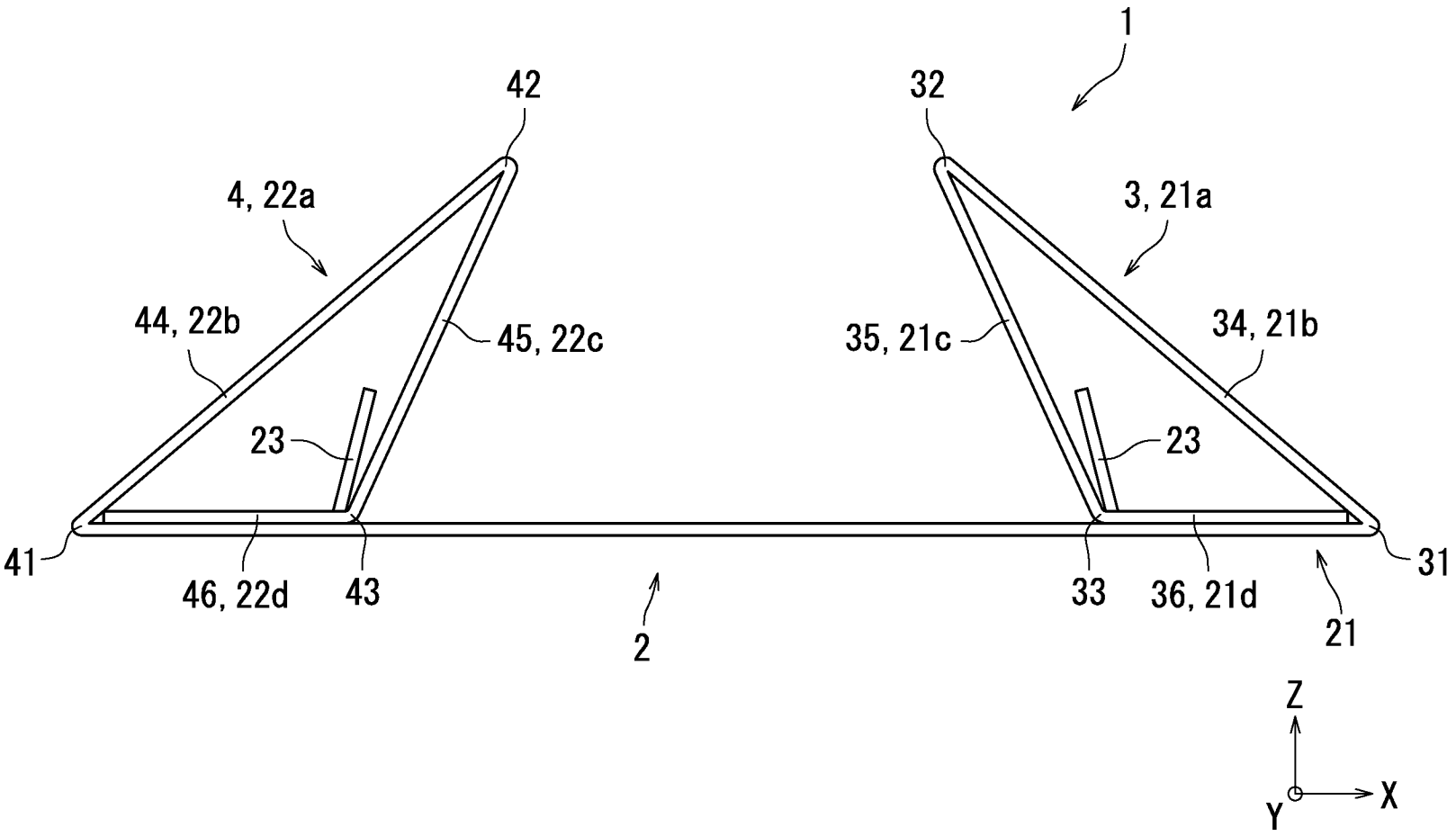
FIG. 3 is a front view illustrating the cushioning pad in FIG. 1.

Configuration of the first tubular portion 3 and the second tubular portion 4 will be described next with reference to FIG. 3. FIG. 3 is a front view illustrating the cushioning pad in FIG. 1. As illustrated in FIG. 3, the first tubular portion 3 includes a first ridge corner 31, a second ridge corner 32, a third ridge corner 33, a first wing 34, a second wing 35, and a third wing 36. The second tubular portion 4 includes a first ridge corner 41, a second ridge corner 42, a third ridge corner 43, a first wing 44, a second wing 45, and a third wing 46. The following describes the first tubular portion 3 and explanation about the second tubular portion 4 is omitted which has the same configuration as the first tubular portion 3.

The first ridge corner 31 is located on the end area 21 of the bottom plate portion 2. The first wing 34 forms a part of the plate-shaped member 21*a* and is turned up along the first ridge corner 31. The first wing 34 corresponds to the base segment 21*b* of the plate-shaped member 21*a* described with reference to FIG. 2. The first wing 34 is longer than the second and third wings 35 and 36.

The second ridge corner 32 is located at the tip end of the first wing 34. The second wing 35 forms a part of the plate-shaped member 21*a* and is turned up along the second ridge corner 32. The second wing 35 corresponds to the intermediate segment 21*c* described with reference to FIG. 2. The second wing 35 is longer than the third wing 36.

The third ridge corner 33 is located at the tip end of the second wing 35. The third ridge corner 33 abuts on the bottom plate portion 2. The third wing 36 forms a part of the plate-shaped member 21*a* and is turned up along the third ridge corner 33. The third wing 36 is in contact with the bottom plate portion 2. The third wing 36 extends along the bottom plate portion 2. The third wing 36 corresponds to the tip end segment 21*d* of the plate-shaped member 21*a* described with reference to FIG. 2.

Figure 4:
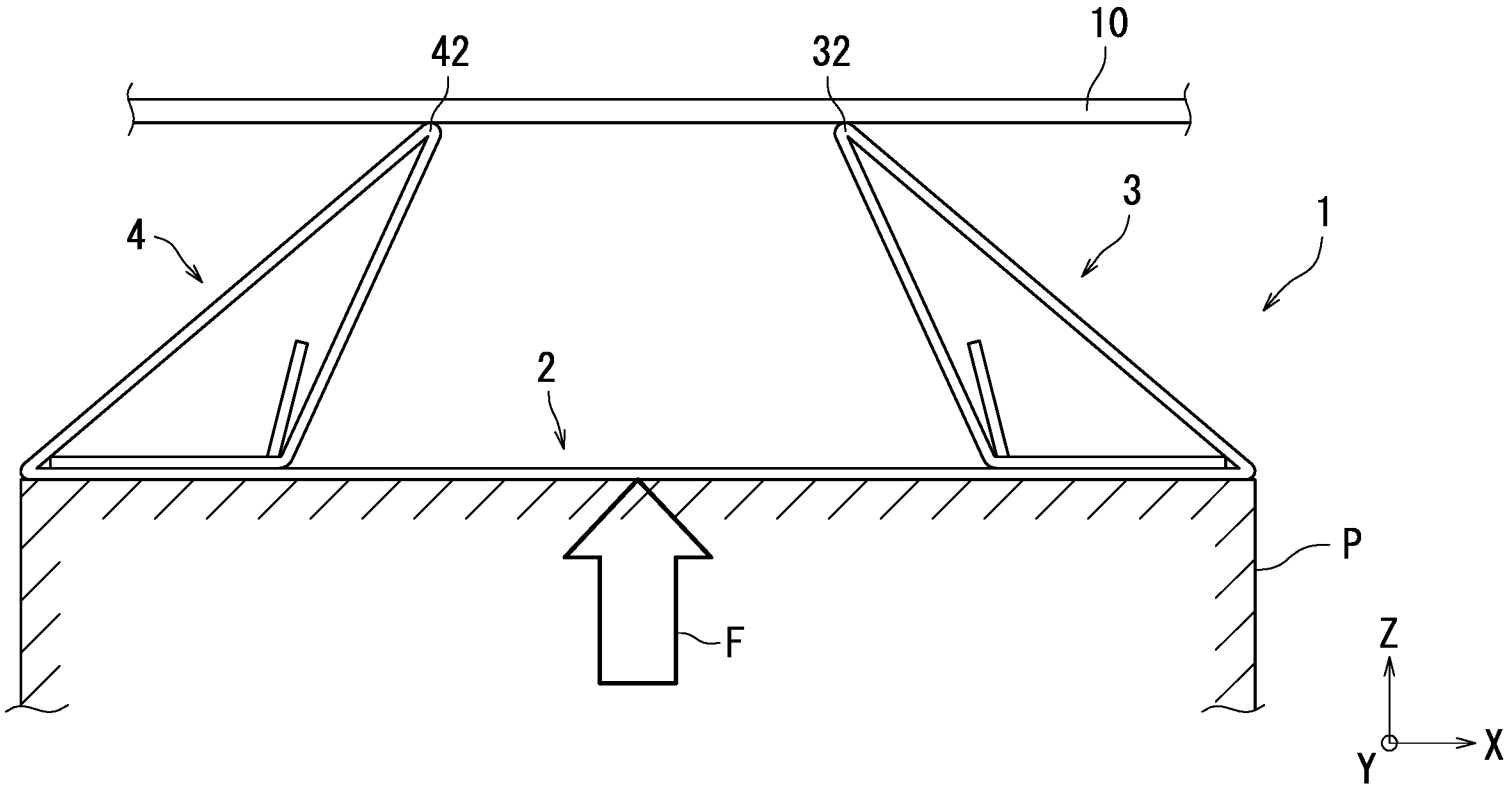
FIG. 4 illustrates the cushioning pad.

Resilient deformation of the cushioning pad 1 will be described next with reference to FIGS. 4 and 5. FIG. 4 illustrates the cushioning pad 1. The cushioning pad 1 is accommodated in a package 10 together with a packed article P in FIG. 4. The cushioning pad 1 is disposed between the package 10 and the packed article P.

The bottom plate portion 2 of the cushioning pad 1 is in contact with the packed article P. The second ridge corner 32 of the first tubular portion 3 of the cushioning pad 1 is in contact with the package 10. The second ridge corner 42 of the second tubular portion 4 of the cushioning pad 1 is also in contact with the package 10.

Upon occurrence of relative displacement between the packed article P and the package 10, impact acts on the cushioning pad 1 from the package 10 and the packed article P. Specifically, when the package 10 is displaced in the up-and-down direction Z, impact acts on the cushioning pad 1. The impact acts on the first and second tubular portions 3 and 4 for example in a manner to compress the cushioning pad 1 between the packed article P and the package 10.

Figure 5:
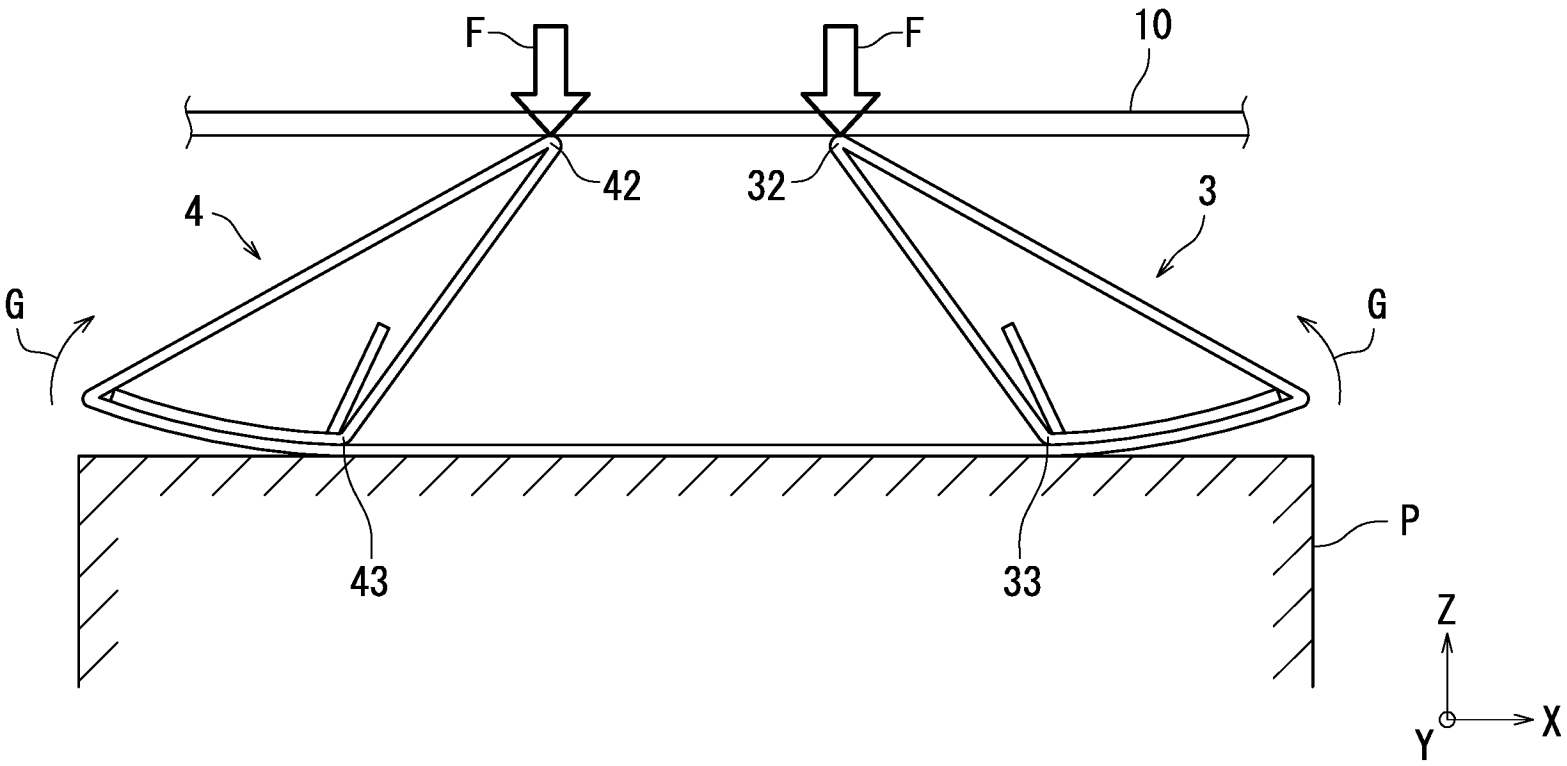
FIG. 5 illustrates the cushioning pad.

FIG. 5 is a front view illustrating the cushioning pad 1. The end areas 21 and 22 of the cushioning pad 1 are resiliently deformed in FIG. 5. Arrows F in FIG. 5 each indicate a direction in which impact acts on the cushioning pad 1. Also, arrows G in FIG. 5 indicate respective directions in which the first and second tubular portions 3 and 4 warp.

Upon receipt of impact, the first tubular portion 3 warps about the third ridge corner 33 as a pivot axis between the packed article P and the package 10. The first tubular portion 3 warps in a manner to roll up the end area 21. As a result, the first tubular portion 3 warps and resiliently deforms into an arc shape in the end area 21. Upon receipt of impact, the second tubular portion 4 warps about the third ridge corner 43 as a pivot axis between the packed article P and the package 10. The second tubular portion 4 warps in a manner to roll up the end area 22. As a result, the second tubular portion 4 warps and resiliently deforms into an arc shape in the end area 22.

The end areas 21 and 22 are each deformed into an arc shape upon impact acting on the first and second tubular portions 3 and 4 of the cushioning pad 1 in the present embodiment. In the above configuration, impact acting on the cushioning pad 1 is distributed to the end areas 21 and 22 of the bottom plate portion 2. As a result, impact acting on the packed article P can be mitigated. Further, the end areas 21 and 22 each resiliently deformed into an arc shape regain an original plate shape once the impact is eliminated. As a result, permanent deformation of the cushioning pad 1 can be reduced, thereby enabling repetitive use of the cushioning pad 1.

Note that in a situation in which the sheet S described with reference to FIGS. 2 and 5 is formed out of corrugated cardboard, the sheet S is preferably formed such that the width direction of the corrugated cardboard coincides with the left-right direction X. When doing so, the end areas 21 and 22 each are hardly bent in resilient deformation thereof into an arc shape with a result that permanent deformation of the cushioning pad 1 can be further reduced.

Figure 6:
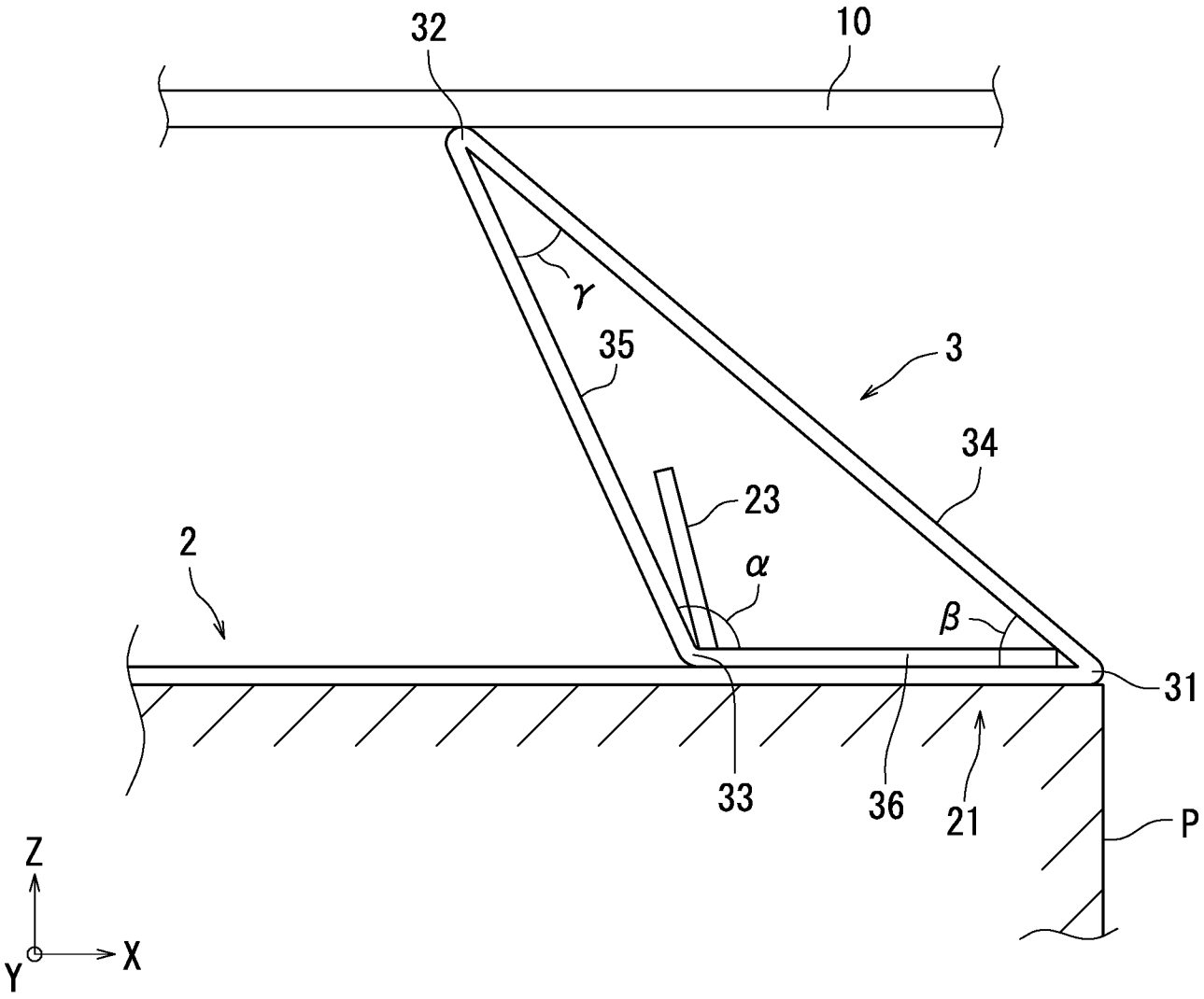
FIG. 6 is an enlarged view illustrating a first tubular portion in FIG. 4.

The configuration of the first tubular portion 3 will be further described with reference to FIG. 6. FIG. 6 is an enlarged view illustrating the first tubular portion 3 in FIG. 4. Explanation of the configuration of the second tubular portion 4 is omitted herein which has the same configuration as the first tubular portion 3.

As illustrated in FIG. 6, an angle $\alpha$ between the second and third wings 35 and 36 is larger than 90°. In the above configuration, the first tubular portion 3 can be readily warp about the third ridge corner 33 as a pivot axis between the packed article P and the package 10 upon receipt of impact.

The tip end of the third wing 36 abuts on the first ridge corner 31. In the above configuration, relative sliding of the bottom plate portion 2 and the third wing 36 can be prevented in warping of the first tubular portion 3. The third wing 36 is overlaid on the bottom plate portion 2. In the above configuration, the third wing 36 can prevent the end area 21 from being bent at a given point in resilient deformation of the end area 21.

Dimension of the first tubular portion 3 will be described next. The weight of the packed article P is in a range for example from 1.2 kg to 3.8 kg. In a situation for example in which the weight of the packed article P is at least 1.2 kg, the cushioning pad 1 can exert cushioning characteristics in a manner to resiliently deform the end area 21. By contrast, in a situation for example in which the weight of the packed article P is no greater than 3.8 kg, the cushioning pad 1 can exert the cushioning characteristics without bending the end area 21.

An angle $\beta$ between the end area 21 and the first wing 34 is in a range for example from 35° to 45°. In a configuration in which the angle $\beta$ is no greater than 45°, the first tubular portion 3 can readily warp about the third ridge corner 33 as a pivot axis. In a configuration in which the angle $\beta$ is at least 35°, the first tubular portion 3 can have increased cushioning characteristics.

The length of the first wing 34 is in a range for example from 100 mm to 110 mm. In a configuration in which the first wing 34 has a length of at least 100 mm, the first tubular portion 3 can readily warp about the third ridge corner 33 as a pivot axis. In a configuration in which the first wing 34 has a length of no greater than 110 mm, the first tubular portion 3 can have increased cushioning characteristics.

An angle $\gamma$ between the first and second wings 34 and 35 is in a range for example from 20° to 30°. In a configuration in which the angle $\gamma$ is no greater than 30°, the first tubular portion 3 can readily warp about the third ridge corner 33 as a pivot axis. In a configuration in which the angle $\gamma$ is at least 20°, the first tubular portion 3 can have increased cushioning characteristics.

As described with reference to FIGS. 1, 2, and 6, the holes 21*e* are located across the intermediate segment 21*c* in the left-right direction X into the base segment 21*b* by the predetermined length. In the above configuration, the contact area between the second ridge corner 32 and the package 10 can be reduced to allow the first tubular portion 3 to readily slide on the package 10. As a result, the first tubular portion 3 can readily warp about the third ridge corner 33 as a pivot axis between the packed article P and the package 10 upon receipt of impact.

Figure 7:
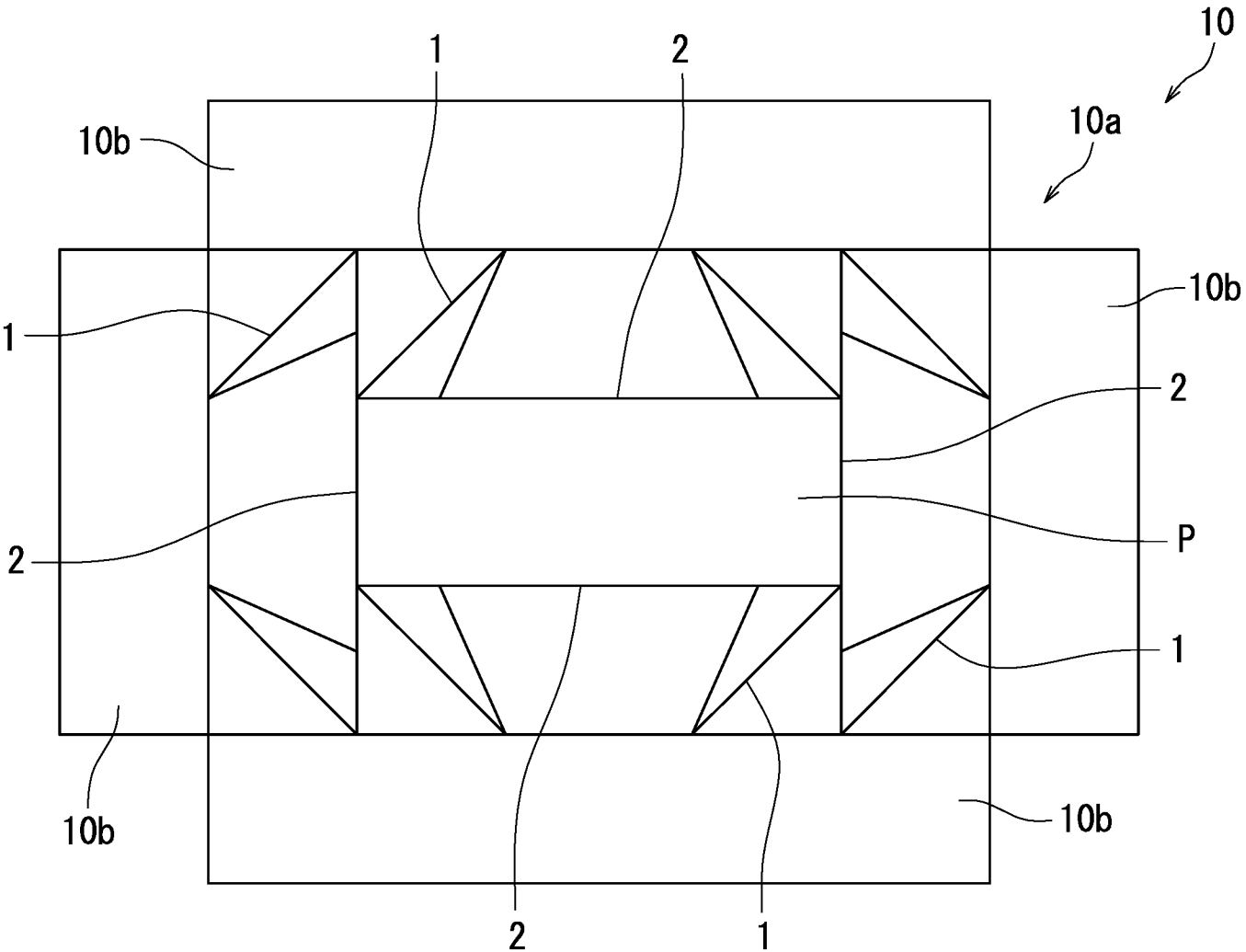
FIG. 7 is a plan view illustrating a package according to the embodiment of the present disclosure.

Configuration of the package 10 will be described with reference to FIG. 7. FIG. 7 is a plan view illustrating the package 10. As illustrated in FIG. 7, the package 10 includes a plurality of the cushioning pads 1, a main body 10*a*, and upper lids 10*b*. The main body 10*a* has a box shape. The main body 10*a* is openable by opening the upper lids 10*b*.

The main body 10*a* accommodates the cushioning pads 1 and the packed article P. The cushioning pads 1 and the packed article P are accommodated in the main body 10*a* after the upper lid 10*b* are opened. The cushioning pads 1 surround the packed article P to prevent collision between the main body 10*a* and the packed article P. The cushioning pads 1 are in contact at the bottom plate portion 2 thereof with the packed article P. In the above configuration, even when relative displacement between the packed article P and the package 10 occurs for example upon falling of the package 10, the cushioning pads 1 can absorb impact acting on the packed article P.

The cushioning pad 1 and the package 10 according to an embodiment of the present disclosure have been described so far with reference to FIGS. 1-7. However, the present disclosure is not limited to the above-described embodiment and can be practiced in various ways within the scope not departing from the gist of the present disclosure.

For example, the sheet S used for the cushioning pad 1 is made from paper such as cardboard in the embodiment of the present disclosure, which however should not be taken to limit the present disclosure. It is only required that the sheet S has flexibility. The sheet S may be for example made from resin such as rubber or foam. Alternatively, the sheet S may be for example made from metal such as aluminum.

Furthermore, for example, the bottom plate portion 2, the first tubular portion 3, and the second tubular portion 4 are integral as a single sheet S in the embodiment of the present disclosure, which however should not be taken to limit the present disclosure. It is only required that the first tubular portion 3 is located along the end area 21 of the bottom plate portion 2 and the second tubular portion 4 is located along the end area 22 of the bottom plate portion 2. For example, it is possible that after the first tubular portion 3, the second tubular portion 4, and the bottom plate portion 2 are prepared as separate members, the first tubular portion 3 is bonded to the end area 21 of the bottom plate portion 2 and the second tubular portion 4 is bonded to the end area 22 of the bottom plate portion 2. In a situation in which any one of the bottom plate portion 2, the first tubular portion 3, and the second tubular portion 4 is broken in the above configuration, the cushioning pad 1 can be reused through replacement of only the broken one.

The plate-shaped members 21*a* and 22*a* have the respective pairs of holes 21*e* and 22*e* in the embodiment of the present disclosure, which however should not be taken to limit the present disclosure. It is only required that the plate-shaped members 21*a* and 22*a* each have at least one of the corresponding holes 21*e* or 22*e*. Formation of for example respective single holes 21*e* and 22*e* in the plate-shaped members 21*a* and 22*a* can increase rigidity of the plate-shaped members 21*a* and 22*a*. By contrast, formation of respective three or more holes 21*e* or 22*e* in the plate-shaped members 21*a* and 22*a* can allow the first and second tubular portions 3 to readily slide on the package 10. Note that the number of the engagement parts 23 provided on the bottom plate portion 2 is equal to the total number of the holes 21*e* and 22*e*.

Moreover, for example, the weight of the packed article P is specified and the thickness of the sheet S and the dimension of the first tubular portion 3 are determined in the embodiment of the present disclosure, which however should not be taken to limit the present disclosure. The thickness of the sheet S and the dimension of the first tubular portion 3 may be set in respective specific ranges so as to correspond to the weight and shape of the packed article P.

The drawings are schematic illustrations that emphasize elements of configuration in order to facilitate understanding thereof. Therefore, in order that elements of configuration can be easily illustrated, dimensions such as thickness and length of each of the elements of configuration in the drawings may differ from the actual dimensions thereof. Also note that material properties, shapes, and the like, described for each of the elements of configuration in the above embodiment are only examples and are not intended to impose any particular limitations on the elements of configuration and can be changed in various manners within the scope not substantially departing from the advantages of the present disclosure.

What is claimed is:

1. A cushioning pad disposed between a package main body and a packed article, comprising:

a bottom plate portion having a pair of end areas opposite to each other;

a first tubular portion having a triangular tubular shape along one of the end areas; and a second tubular portion having a triangular tubular shape along another of the end areas, wherein the one of the end areas resiliently deforms into an arc shape upon impact acting on the first tubular portion, the other of the end areas resiliently deforms into an arc shape upon impact acting on the second tubular portion, the first tubular portion is a plate-shaped member folded up into the triangular tubular shape, the plate-shaped member continuing from the one of the end areas, the second tubular portion is a plate-shaped member folded up into the triangular tubular shape, the plate-shaped member continuing from the other of the end area, the first tubular portion and the second tubular portion each include:

a first ridge corner located at the end area of the bottom plate portion, a first wing turned up along the first ridge corner;

a second ridge corner located at a tip end of the first wing;

a second wing turned up along the second ridge corner; and a third ridge corner located at a tip end of the second wing, the third ridge corner abutting on the bottom plate portion, upon impact acting on the first tubular portion, the first tubular portion warps about the third ridge corner of the first tubular portion as a pivot axis, and upon impact acting on the second tubular portion, the second tubular portion warps about the third ridge corner of the second tubular portion as a pivot axis.

2. The cushioning pad according to claim 1, wherein an angle between the end area of the bottom plate portion and the first wing of each of the first and second tubular portions is at least 35° and no greater than 45°.

3. The cushioning pad according to claim 1, wherein an angle between the first and second wings of each of the first and second tubular portions is at least 20° and no greater than 30°.

4. A package comprising:

the cushioning pad according to claim 1; and the package main body having a box shape, wherein the main body accommodates the cushioning pad and the packed article.

5. A cushioning pad disposed between a package main body and a packed article, comprising:

a bottom plate portion having a pair of end areas opposite to each other;

a first tubular portion having a triangular tubular shape along one of the end areas; and a second tubular portion having a triangular tubular shape along another of the end areas, wherein the one of the end areas resiliently deforms into an arc shape upon impact acting on the first tubular portion, the other of the end areas resiliently deforms into an arc shape upon impact acting on the second tubular portion, the first tubular portion and the second tubular portion each include:

a first ridge corner located at the end area of the bottom plate portion, a first wing turned up along the first ridge corner;

a second ridge corner located at a tip end of the first wing;

a second wing turned up along the second ridge corner; and a third ridge corner located at a tip end of the second wing, the third ridge corner abutting on the bottom plate portion, upon impact acting on the first tubular portion, the first tubular portion warps about the third ridge corner of the first tubular portion as a pivot axis, and upon impact acting on the second tubular portion, the second tubular portion warps about the third ridge corner of the second tubular portion as a pivot axis, the first and second tubular portions each further include a third wing, the third wing extends from the second ridge corner and is turned up along the third ridge corner while in contact with the bottom plate portion, and an angle between the second and third wings is larger than 90°.

6. The cushioning pad according to claim 5, wherein the third wing has a tip end abutting on the first ridge corner.

7. The cushioning pad according to claim 5, wherein the bottom plate portion includes engagement parts capable of engaging with respective engagement targets provided in the first and second tubular portions.

8. A cushioning pad disposed between a package main body and a packed article, comprising:

a bottom plate portion having a pair of end areas opposite to each other;

a first tubular portion having a triangular tubular shape along one of the end areas; and a second tubular portion having a triangular tubular shape along another of the end areas, wherein the one of the end areas resiliently deforms into an arc shape upon impact acting on the first tubular portion, the other of the end areas resiliently deforms into an arc shape upon impact acting on the second tubular portion, the bottom plate portion includes engagement parts capable of engaging with respective engagement targets provided in the first and second tubular portions, the engagement parts each have a trapezoidal shape having a short base and a long base parallel to each another, and the bottom plate portion has a hole adjoining to the long base.

* * * * *